United States Patent [19]

English

[11] 4,266,779

[45] May 12, 1981

[54] ANIMATED ROPING TRAINING APPARATUS

[76] Inventor: Jackie L. English, 940 Matley La., #7, Reno, Nev. 89502

[21] Appl. No.: 46,273

[22] Filed: Jun. 7, 1979

[51] Int. Cl.[3] ..... A63K 3/00; A63B 69/00; A63H 11/10

[52] U.S. Cl. ..... 273/359; 119/29; 46/107

[58] Field of Search ..... 119/29; 273/366, 359; 46/123, 107, 108, 106; 35/29 R

[56] References Cited

U.S. PATENT DOCUMENTS

| | | | |
|---|---|---|---|
| 1,722,340 | 7/1929 | Richter | 46/107 |
| 3,776,553 | 12/1973 | Kelton | 46/119 X |
| 3,974,799 | 8/1976 | Parsons | 119/29 X |
| 4,136,874 | 1/1979 | McCord | 119/123 X |

*Primary Examiner*—F. Barry Shay
*Assistant Examiner*—Robert P. Swiatek
*Attorney, Agent, or Firm*—Townsend and Townsend

[57] ABSTRACT

A system for roping practice by horse-mounted individuals includes a wheel-mounted target animal and a cabled reeving system to interconnect the target animal and horse and thereby provide motive force to move the target animal. The target animal has a front wheel that is eccentrically mounted to provide a loping effect, and pivotally attached rear leg elements which cooperate with the eccentrically mounted front wheel to effect a kicking action, as the target animal is moved.

9 Claims, 4 Drawing Figures

ANIMATED ROPING TRAINING APPARATUS

The present invention pertains to apparatus for providing roping training for horse-mounted individuals and, in particular, is directed to an animated target that is powered by the horse itself.

BACKGROUND OF THE INVENTION

In days gone by, animal roping using a lariat or lasso by horse-mounted persons such as, for example, calf or steer roping, was a necessary art or skill for many persons employed on cattle ranches. Proficiency was usually obtained by on-the-job training, so to speak, and/or hours of diligent practice; and in this regard, the individual usually had available an abundance of animals upon which to practice.

However, present-day roping proficiency is not so much a necessity as it is an art form preserved in sport. Often, the individual wishing to better his or her practice of this art must do so by artificial means; that is, since a ready supply of animals may not be available, roping practice must be obtained through the use of mechanized target devices.

Accordingly, there has been a number of such mechanized target devices recently made available. Some of the more complex apparatus available in the prior art includes mechanized training devices having self-contained power sources including a radio transmitter/-receiver combination for controlling operation. There are also devices available that are towed by electronically operable power wiches and devices using inertia motor and a starting mechanism to initiate and store motion. Examples of the foregoing may be found by reference to U.S. Pat. Nos. 3,303,821, 3,324,832, 3,711,098 and 3,947,033.

With one exception, the above devices all require a source of electrical power. In the case of the device using the inertial motor, a starting mechanism is required. Furthermore,many of the training devices available today, including some of the ones discussed above, are so complex as to be commercially unfeasible and unacceptable. While many of the roping training devices presently available provide animation, simulating movements of a live animal, they do so at an almost prohibitive cost.

A further problem with many of the presently available mechanized roping training devices resides in the inability of the target mechanism to stay ahead of the horse that an individual rides while chasing the target.

SUMMARY OF THE INVENTION

Accordingly, there exists the need for a simple, inexpensive, training device that overcomes the problems set forth above.

Thus, the present invention provides an animated target animal that simulates the movements of a running animal for roping practice by horse-mounted individuals. According to the present invention, therefore, there is provided a target animal and a reeving system that uses a cable to interconnect the target animal and the horse upon which an individual is mounted. Thereby, the horse-mounted individual provides the motive for moving the target animal. Utilizing guide pulleys that are attached at spaced locations to a fence, or similar apparatus used to form the periphery of a roping training arena, the reeving system interconnects the target animal and the pursuing horse so that the target animal remains spaced a predetermined distance from the pursuing horse (and horse-mounted individual).

In the preferred embodiment, the target animal includes a body portion, configured to resemble a steer, mounted on a triwheeled (a single front and two spaced, parallel rear wheels) frame. The front wheel is eccentrically attached to the frame to provide the target animal with a cyclic, loping effect. Rear leg elements are pivotally mounted to the back portion of the body and depend downward therefrom. The leg elements are provided with a predetermined length so that as the target animal is moved, the cyclic vertical motion of the back portion (caused by the eccentricity of the frame-front wheel connection) causes the leg elements to strike the ground and caused to kick back, providing a simulated kicking effect.

A number of advantages are achieved by the present invention. First, the invention provides apparatus that is inexpensive, easy to build and use, and effectively trains persons in the use of lariat or lasso for roping moving animals from horseback. In addition, the invention is also effective in training the horse upon which the individual uses to pursue moving animals at the proper speed and distance. The eccentrically-mounted front wheel gives the head portion of the target animal a "bobbing" effect, similar to that of live animals, thereby presenting a more representative target for the trainee. Further, this same eccentricity is used to also provide the rear leg elements of the target animal with a simulated kicking motion and presenting both the trainee and the horse with a more realistic animal simulation to pursue.

This kicking motion of rear leg elements obtains a further advantage for both individual and team roping practice. For individual roping practice, the head portion of the target animal is used. Team roping practice, however, can require the horse-mounted individual to obtain proficiency in roping the rear legs of the animal. Accordingly, the present invention provides rear leg elements that, in addition to the capability of being roped, present a challenging and realistic target because of the simulated kicking action mentioned above.

These and still further advantages of the present invention will be understood, as well as the nature of the invention, when reference is had to the accompanying drawings taken in conjunction with the following written description.

DETAILED DESCRIPTION OF THE PREFERRED EMBODIMENT

Figure 1:
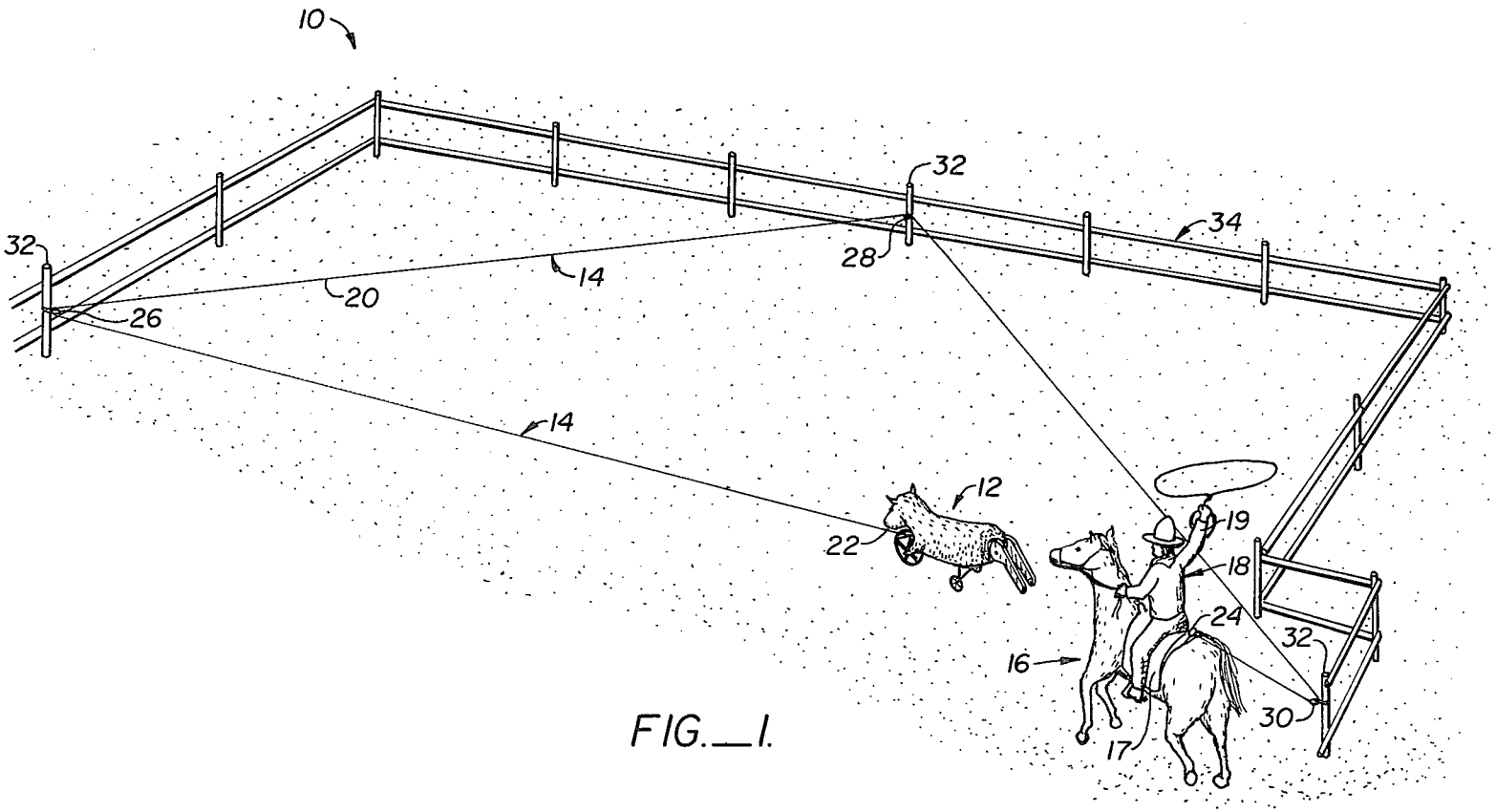
FIG. 1 is a perspective view of the roping training apparatus of the present invention illustrating its use.

Referring now to the drawings, and in particular FIG. 1, there is illustrated the roping training apparatus of the present invention generally designated by the reference numeral 10. The roping training apparatus 10 is shown as comprising a target animal 12 and a reeving system 14 that interconnects the target animal 12 and a horse 16 upon which a person 18 rides.

The reeving system 14 includes a cable 20 and guide pulleys 26, 28 and 30. One end 22 of the cable 20 is attached to a front portion of the target animal 12, while the other end 24 of the cable 20 is attached to the horse 16 such as, for example, being connected to the saddle 17. Attachment of the ends 22 and 24 of the cable 20 to the target animal 12 and horse 16, respectively, may be accomplished by any appropriate means such as, for example, forming loops on the respective ends of the cable 20 and affixing them via a bolt or other retaining means to the target animal 12 and saddle 17.

Each guide pulley 26, 28 and 30 of the reeving system 14 utilizes three upright posts 32 that are a part of the fencing 34 which defines the roping training area illustrated in FIG. 1. It should be evident that fencing 34 is not essential to the construction of the present invention; that is, the reeving system 14 can just as easily be established using appropriately located trees or other similar upright structure, forming the points of a triangle, to which the guide pulleys 26, 28 and 30 may be attached. It should also be noted that although two guide pulleys would allow the invention to function, it is preferred that at least three such pulleys be used, arranged as illustrated in FIG. 1, to avoid the possibility of entanglement of the horse 16 with the cable 20.

Figure 2:
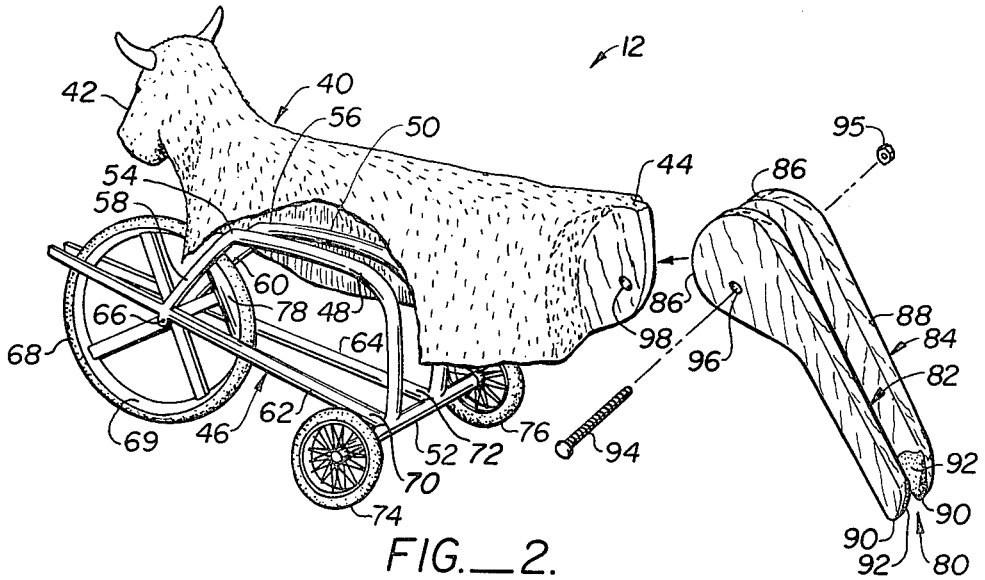
FIG. 2 is an exploded view, in perspective, of the target animal of FIG. 1.

Referring now to FIG. 2, the target animal 12 is shown as including a body member 40 (drawn in phantom for clarity) shaped and configured to resemble the body portions of a steer, including a head portion 42 and rear portion 44. The body member 40 is mounted to a frame 46 comprising a pair of spaced, generally parallel runners 48 and 50 secured at their rear ends to a lateral axle 52. The forward ends 54 and 56 of the runners 48 and 50, respectively, are connected to oblique supports 58 and 60. The oblique supports 58 and 60 converge downwardly and are joined to fork members 62 and 64, which extend from the lateral axle 52, by a front axle 66 that journals a front wheel 68 to the frame 46. The rear ends 70 and 72 of fork members 62 and 64, respectively, are joined to the lateral axle 52 at spaced locations thereon. Rotatably mounted to the terminal portions of the lateral axle 52 are rear wheels 74 and 76.

The single front wheel 68 is eccentrically mounted to the axle 66 to provide the target animal 12 with a loping effect, as will be further described below. Affixed to the interior surface of rim 69 of the wheel 68 is a counter-weight 78. The counter-weight is located on the portion of rim 69 closest to the axle 66 and helps to keep the wheel 68 on the ground when the target animal 12 is being propelled at relatively high speeds.

Pivotally attached to the rear portion 44 of the target animal 12 are left and right leg elements 82 and 84. Each of the leg elements 82 and 84 includes a cantilevered section 86 from which depends a vertical element 88. Affixed to the bottom or terminal portion 90 of each vertical element 88 is a weight 92 which acts to return and maintain the vertical element in a more or less vertical position.

As illustrated in FIG. 2, the rear portion 44 of the target animal 12 is shaped and configured to receive left and right leg elements 82 and 84 in relative spaced-apart, parallel relation. The leg elements 82 and 84 are pivotally attached to the rear portion 44 via a bolt 94 that extends through apertures 96 in the cantilevered portions 86 of the left and right leg elements 82 and 84 and the aperture 98 of the rear portion 44. A nut 95 secures the bolt 94 to hold the bolt and leg elements 82 and 84 in place.

Figure 3A:
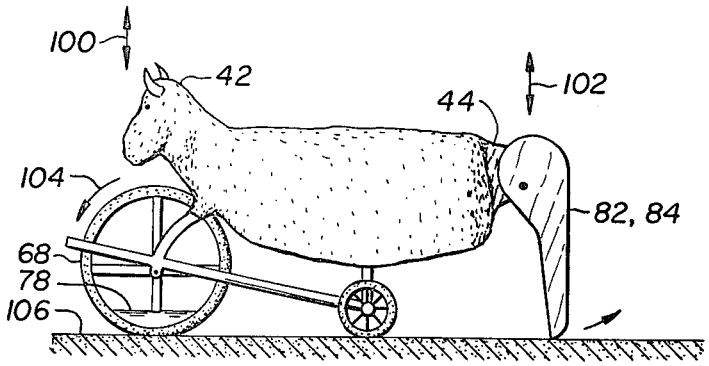
FIGS. 3A–3B are cartoon-like illustrations of the animation of the target animal.
Figure 3B:
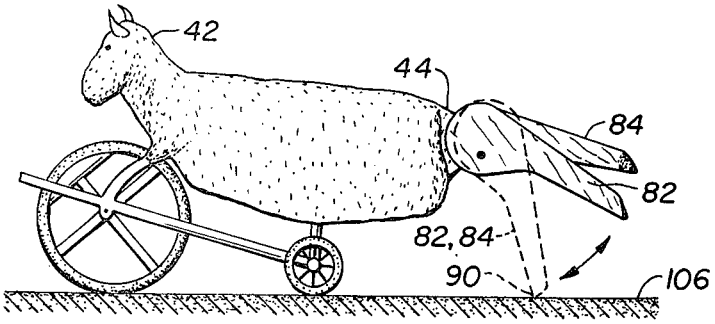

Referring to FIGS. 1 and 3A–3B, the cable 20 is reeved through the guide pulleys 26, 28 and 30—which have been placed and affixed to upright posts 32 of fencing 34 to form the triangular pattern illustrated in FIG. 1 and described above. One end of the cable is attached to the front portion 22 of the target animal 12. The other end of the cable is attached to the horse 16 (e.g., to the saddle 17). Preferably, the length of cable 20, and the connection of cable 20 to the target animal 12 and horse 16 are made so that a predetermined spaced relation between the two is maintained during the pursuit of the target animal 12 by the horse-mounted individual 18. In this manner, the possibility of the pursuing horse 16 overrunning the target animal 12 during the chase is obviated.

If not already done so, relative placement of the target animal 12 and horse 16 within the arena defined by fencing 34 is made much as illustrated in FIG. 1; that is, the horse 16 is positioned relatively near the upright post 32 having guide pulley 30 attached. Concomitantly, the target animal is positioned at a point in the arena removed a sufficient distance from the upright 32 bearing the guide pulley 26. The obvious effect of such positioning, prior to use of the invention, is to provide the horse 16 and rider 18 sufficient "running room" for roping practice.

So readied, the roping practice system 10 of the present invention operates as follows: Pursuit of the target animal 12 begins when the horse-mounted individual 18 spurs his horse 16 into action—generally toward the target animal. Of course, as the horse 16 moves toward the target animal 12, the target animal 12, in turn, is pulled away from the pursuing horse and rider 16, 18, respectively, by the cable 20 of the reeving system 14. Further, as the target animal 12 moves, the wheel 68 is caused to rotate. The eccentric attachment of the wheel 68 to the frame 46 gives the target animal 12 a loping effect by providing the head and rear portions 42 and 44 alternate, cyclic vertical motion, as illustrated by the arrows 100 and 102 in FIGS. 3A–3B. For example, FIG. 3A illustrates the front wheel 68 of the target animal 12 at its lowest ebb. As the target animal 12 moves forward, the wheel 68 will rotate in a direction indicated by the arrow 104. In turn, the head portion 42 of the target animal 12 moves upwardly while the rear portion 44 moves downwardly until the front wheel 68 has rotated the axle 66 to its highest point above the ground 106. As the front wheel continues to rotate past this high point and in the direction of the arrow 104, the head portion 42 moves downwardly and the rear portion now moves upwardly. Thereby, the loping effect of a pursued steer is simulated.

Further, when rotation of the front wheel 68 positions the axle 66 at its low point (FIG. 3A), in turn positioning the rear portion 44 of the target animal 12 at its zenith of vertical movement, the leg elements 82 and 84 are of a length so that they hang generally vertically from the rear portion 44—barely touching the arena floor 106 if at all. When the rear portion 44 begins its descent, the terminal portions 90 of leg elements 82 and 84 are brought into contact with the arena floor (illustrated in phantom in FIG. 3B). This contact causes the leg elements 82 and 84 to be kicked rearwardly, as illustrated in FIG. 4B, simulating a kicking effect normally made by pursued calves and steers. In addition, it provides a rear leg target for roping.

While the above provides a full and complete disclosure of the preferred embodiments of the invention, various modifications, alternate constructions and equivalents may be employed without departing from the true spirit and scope of the invention. For example, the rear wheels 74 and 76 may also be eccentrically mounted to provide additional reciprocal, loping effect to the target animal 12. Therefore, the above description and illustrations should not be construed as limiting the scope of the invention which is defined by the appended claims.

What is claimed is:

1. Roping practice apparatus that simulates an animal running on a generally horizontal surface for use by a person mounted on a pursuing horse, the apparatus comprising:

target means for simulating said animal including a frame, head and body elements mounted on said frame, said head and body elements being shaped and configured to simulate the head and upper back portions of an animal, and ground-engaging means mounted to said frame for supporting said target means on said surface; and means for propelling said target in a direction generally away from the pursuing horse including means for interconnecting said target and said horse, said interconnecting means including at least three upright members located in spaced-apart relation to one another and generally circumscribing said horizontal surface and a reeving system comprising at least three pulley elements through which is passed a flexible cable, said cable interconnecting said target means and said horse, each of said pulley elements being attached to a corresponding one of said upright members.

2. The apparatus of claim 1, wherein said ground-engaging means includes at least one wheel that is eccentrically mounted to said frame in generally underlying relation to the head element, said eccentrically mounted wheel being adapted to impart a generally vertical, reciprocal movement to said head element when said target means is moved across said surface.

3. The apparatus of claim 2, including leg elements pivotally attached to a rear portion of said body element of said target means, said leg elements being configured and dimensioned to depend generally, vertically downward.

4. The apparatus of claim 3, wherein said leg elements are of a predetermined dimension sufficient to allow terminal portions of said leg elements to engage said surface, thereby imparting a kicking action to said leg elements when said target means is moved across said surface.

5. The apparatus of claim 4, wherein said predetermined dimension allows the terminal portions of said leg elements to engage said surface only when the head element is generally at the zenith of said vertical movement.

6. Roping practice apparatus for use by a horse and a horse-mounted individual in a roping arena defined by a generally horizontal surface circumscribed by a plurality of generally upright, spaced elements, the apparatus comprising:

a target member including:

a frame having integral front, rear and upper portions;

a front wheel eccentrically mounted to the front portion of said frame for imparting thereto a reciprocating vertical motion when said target member is moved across said surface;

a pair of spaced, parallel wheels mounted to the rear portion of said frame; and a body element attached to and covering at least the upper portion of said frame, the body element being shaped, configured and integrally formed to simulate an animal, said body member including a head element;

a pair of leg elements pivotally attached to said body member proximate the rear portion of said frame, the said leg elements having terminal portions and being dimensioned to cause said terminal portions to engage said horizontal surface when said front portion is moved vertically proximate the zenith of said reciprocating vertical movement imparted thereto by said front wheel; and means for moving said target member across the surface of said arena including a cable, means for attaching the respective ends of said cable to said target member and said horse, and at least three guide pulleys, each being attached to a different one of said upright elements, said cable being reeved through said guide pulleys;

whereby, as said horse moves toward said target member, the target member is correspondingly moved across the surface of said arena simulating a running, loping, kicking animal.

7. The apparatus of claim 6, including weighting means attached to the terminal portions of said leg members for urging said terminal portions toward said surface.

8. The roping practice apparatus of claim 6, wherein said front wheel includes a surface-engaging circumference and a weighting member mounted adjacent said circumference for minimizing bounce of said front wheel as said target member is moved across said surface.

9. The roping practice apparatus of claim 8, wherein said front wheel includes a hub element for eccentrically mounting said front wheel to said front portion; and said weighted member being mounted to a portion of said front wheel circumference most proximate said hub element.

* * * * *